US010002483B2

(12) United States Patent
Sandhu

(10) Patent No.: US 10,002,483 B2
(45) Date of Patent: Jun. 19, 2018

(54) METHOD OF FORMING AND VISUALIZING LATENT IMAGE

(75) Inventor: Adarsh Sandhu, Kanagawa (JP)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 978 days.

(21) Appl. No.: 13/369,136

(22) Filed: Feb. 8, 2012

(65) Prior Publication Data

US 2012/0141746 A1 Jun. 7, 2012

Related U.S. Application Data

(63) Continuation of application No. 12/614,014, filed on Nov. 6, 2009, now Pat. No. 8,137,770.

(30) Foreign Application Priority Data

May 29, 2009 (JP) ..... 2009-131536

(51) Int. Cl.

| | |
|---|---|
| ***B42D 25/29*** | (2014.01) |
| ***B42D 25/369*** | (2014.01) |
| ***B44F 1/10*** | (2006.01) |
| ***G07D 7/04*** | (2016.01) |
| ***H01F 1/44*** | (2006.01) |
| ***H01F 41/00*** | (2006.01) |
| ***H01F 41/16*** | (2006.01) |

(52) U.S. Cl.

CPC ..... *G07D 7/04* (2013.01); *B42D 25/29* (2014.10); *B42D 25/369* (2014.10); *B44F 1/10* (2013.01); *H01F 1/447* (2013.01); *H01F 41/16* (2013.01); *B42D 2033/16* (2013.01); *B42D 2035/34* (2013.01); *Y10T 428/24802* (2015.01); *Y10T 428/25* (2015.01)

(58) Field of Classification Search

CPC ..... H01F 1/44; H01F 41/16; Y10T 428/24802

See application file for complete search history.

(56) References Cited

U.S. PATENT DOCUMENTS

| | | | | |
|---|---|---|---|---|
| 5,401,313 A * | 3/1995 | Supplee | ..... | C04B 20/12 106/12 |
| 5,621,864 A * | 4/1997 | Benade | ..... | G06K 1/121 358/1.18 |
| 5,667,924 A | 9/1997 | Ziolo | | |

(Continued)

FOREIGN PATENT DOCUMENTS

| | | |
|---|---|---|
| EP | 0565988 | 10/1993 |
| JP | 6089357 | 3/1994 |

(Continued)

OTHER PUBLICATIONS

Japanese Office Action issued in JP 2009-131536 dated Jun. 29, 2009 (with English translation).

*Primary Examiner* — Gerard Higgins
*Assistant Examiner* — Sathavaram I Reddy

(57) ABSTRACT

A method of visualizing a latent image includes: preparing a latent image composed of a plurality of paramagnetic seeds immobilized on a base in the form of an image, and a dispersion liquid of paramagnetic colloidal particles; immersing the latent image in the dispersion liquid of paramagnetic colloidal particles; and applying a magnetic field to the latent image and the dispersion liquid of paramagnetic colloidal particles.

19 Claims, 2 Drawing Sheets

(56) References Cited

U.S. PATENT DOCUMENTS

| | | | | |
|---|---|---|---|---|
| 6,221,138 | B1 * | 4/2001 | Kenny | 106/31.32 |
| 6,395,444 | B1 | 5/2002 | Riehle et al. | |
| 6,767,396 | B2 * | 7/2004 | McElligott et al. | 106/453 |
| 2009/0017232 | A1 | 1/2009 | Watanabe et al. | |
| 2009/0064886 | A1 * | 3/2009 | Hook | B41M 1/06 101/467 |

FOREIGN PATENT DOCUMENTS

| | | | | |
|---|---|---|---|---|
| JP | 7262327 | | 10/1995 | |
| JP | 09-230743 | | 9/1997 | |
| JP | 2007-121388 | | 5/2007 | |
| WO | WO 2008148201 | A1 * | 12/2008 | B82Y 30/00 |

* cited by examiner

METHOD OF FORMING AND VISUALIZING LATENT IMAGE

CROSS-REFERENCE TO RELATED APPLICATIONS

This application is a continuation under 35 U.S.C. § 120 of U.S. application Ser. No. 12/614014, filed on Nov. 6, 2009, now U.S. Pat. No. 8,137,770 and incorporated herein by reference in its entirety, which claims the benefit under 35 U.S.C. § 119(a) of Japanese Application No. 2009-131536, which was tiled on May 29, 2009, and is also incorporated herein by reference in its entirety.

BACKGROUND

1. Field of the Invention

The present invention relates to a method of forming and visualizing a latent image, an authenticity assessment method which can be applied to prevention of fraud, such as counterfeiting or falsification, and a method of recording and reproducing classified information.

2. Description of the Related Art

In order to prevent counterfeiting of valuable instrument, etc., special printing, such as hologram printing, is performed on or watermarks are embedded into part of credit cards, valuable instrument, etc. Such cards and valuable instrument cannot be easily copied by a color copying machine or the like, and thus are effective in preventing counterfeiting to a certain extent. However, holograms or watermarks themselves can be counterfeited, and the effect of preventing counterfeiting is not sufficient.

Furthermore, in another method for preventing counterfeiting, information that shows the authenticity is provided in the form of a latent image in part of credit cards, valuable instrument, etc., and by visualizing the latent image, the authenticity is verified.

As such a latent image, a polarized latent image is known (refer to Japanese Unexamined Patent Application Publication No. 2007-121388).

SUMMARY

In order to visualize a polarized latent image, a special device, such as a polarization filter or a polarization light, is required. Therefore, there is a need for a novel latent image that can be visualized by an easily available device.

As a result of research conducted by the present inventor and others, it has been found that, when a base, on which very small paramagnetic seeds (of several nanometers in size) that cannot be detected visually or by an ordinary optical or magnetic detector are immobilized, is immersed in a dispersion liquid of paramagnetic colloidal particles and a magnetic field is applied thereto, paramagnetic colloidal particles are trapped on the immobilized paramagnetic seeds and joined together one after another to form chain-like aggregates that can be detected visually or by an optical or magnetic detector.

It has been discovered that, using the phenomenon described above, it is possible to provide a latent image that can be visualized by an easily available device, such as a permanent magnet. It has also been discovered that, using the phenomenon described above, it is possible to realize information recording with high confidentiality.

In an aspect of the invention, an authenticity assessment method comprising: preparing a latent image composed of a plurality of paramagnetic seeds immobilized on a base in the form of an image, and a dispersion liquid of paramagnetic colloidal particles; immersing the latent image in the dispersion liquid of paramagnetic colloidal particles; applying a magnetic field to the latent image and the dispersion liquid of paramagnetic colloidal particles; and assessing authenticity on the basis of a visualized image.

In another aspect of the invention, a method of visualizing a latent image includes: preparing a latent image composed of a plurality of paramagnetic seeds immobilized on a base in the form of an image, and a dispersion liquid of paramagnetic colloidal particles; immersing the latent image in the dispersion liquid of paramagnetic colloidal particles; and applying a magnetic field to the latent image and the dispersion liquid of paramagnetic colloidal particles.

In another aspect of the invention, a method of reproducing recorded information includes: preparing an information recording medium having a latent image composed of a plurality of paramagnetic seeds immobilized in the form of an image, and a dispersion liquid of paramagnetic colloidal particles; immersing the latent image in the dispersion liquid of paramagnetic colloidal particles; and applying a magnetic field to the latent image and the dispersion liquid of paramagnetic colloidal particles.

In another aspect of the invention, an article having an authenticity assessment unit includes a closed cell, the interior of which is observable; a base disposed on a bottom of the cell, the base having a latent image portion on which a plurality of paramagnetic seeds are immobilized in the form of an image; and a dispersion liquid of paramagnetic colloidal particles, the dispersion liquid being filled in the cell.

DETAILED DESCRIPTION

Figure 1:
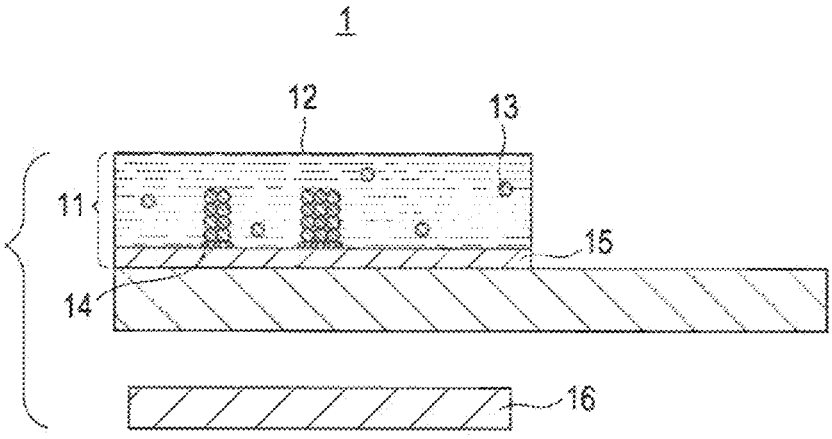
FIG. 1 is a schematic diagram of an article having an authenticity assessment unit according to an embodiment of the present invention.

An embodiment of the present invention will be described in detail below.

According to this embodiment, very small paramagnetic seeds (of several nanometers in size) are immobilized on a base to form a latent image, the latent image is immersed in a dispersion liquid of paramagnetic colloidal particles, and a magnetic field is applied thereto. Thereby, paramagnetic colloidal particles are aggregated in the form of chains, with the immobilized paramagnetic seeds being starting points, so that the latent image is developed and visualized.

It is to be noted that in the present specification and claims, the term "paramagnetism" includes superparamagnetism.

According to this embodiment, a latent image is formed by immobilizing paramagnetic seeds in the form of an image on a base.

The material constituting the base is not particularly limited. Examples thereof include ceramics such as silicon oxide, glass, polymer materials, and paper. Furthermore, the base may be a bank note, a valuable instrument, a credit card, or any of various certificates.

Furthermore, the paramagnetic seeds are not particularly limited as long as they can be immobilized on the base and have paramagnetic properties.

The particle size of paramagnetic seeds is not particularly limited, and paramagnetic seeds can have a size that cannot be detected by an ordinary optical or magnetic detector. For example, the particle size of paramagnetic seeds may be about 8 to 30 nm and furthermore about 10 to 40 nm. Here, the particle size refers to an average of two axes, i.e., an average of major and minor axes, where the major axis and the minor axis respectively correspond to a long side and a short side of a circumscribed rectangle, with a minimum area, circumscribed about a projected image of a particle.

Furthermore, the strength of magnetization of paramagnetic seeds may be about 20 to 30 emu/g and furthermore about 40 to 100 emu/g.

Specific examples of paramagnetic seeds include paramagnetic powder itself; polymer material particles in which paramagnetic seeds are dispersed; and those in which paramagnetic powder is supported by a carrier, such as those in which paramagnetic powder is attached to the surface of core particles composed of a polymer material or those in which paramagnetic powder is supported in carbon nanotubes.

Examples of paramagnetic powder include iron oxides, such as magnetite, hematite, and ferrite, although not limited thereto. The particle size of paramagnetic powder may be, for example, about 1 to 10 nm. When the particle size is in this range. magnetic powder exhibits superparamagnetism. As the particle size increases. magnetic powder tends to become ferromagnetic.

Furthermore, specific examples of the polymer material include polystyrene, styrene copolymers, and polyesters, although not limited thereto. The concentration of paramagnetic powder in paramagnetic seeds may be, for example, 3.0 $g/cm^3$ or more.

The method for immobilizing paramagnetic seeds on the base in the form of an image is not particularly limited, and can be appropriately determined depending on the type of the base. For example, using an ink in which paramagnetic seeds are dispersed, the paramagnetic seeds can be immobilized by printing.

Furthermore, a method may be employed in which the base is subjected to surface chemical modification in the form of an image using a known process in advance, and using bonds (ionic bonds, covalent bonds, etc.) between the surface chemical modifying groups and paramagnetic seeds, chemical immobilization is performed. In such a case, surface chemical modifying groups may also be attached to paramagnetic seeds so that they are bound to the chemical modifying groups on the base.

Furthermore, for example, a method may be employed in which, while observing with a scanning electron microscope, using a micromanipulator (manufactured by Kleindiek Nanotechnik or the like), paramagnetic seeds are placed on a base in the form of an image and immobilized on the base by any given process. The immobilization process is not particularly limited, and any known process may be used. For example, immobilization may be performed by irradiating contact points between the base and paramagnetic seeds with electron beams, or physical bonding may be performed using a polymer material.

The shape of the latent image formed by paramagnetic seeds can be appropriately determined depending on the intended purpose. For example, the latent image may be a symbol, a mark, or the like that shows the authenticity, may be a symbol or an identifier (a bar code, or the like), or may be a classified document itself.

In this embodiment, the base on which a latent image is formed is immersed in a dispersion liquid of paramagnetic colloidal particles, and by applying a magnetic field thereto, chain-like aggregates of paramagnetic colloidal particles are formed on the paramagnetic seeds. Thereby, the latent image is visualized (developed).

The reason for the aggregation of paramagnetic colloidal particles in the form of chains, with the paramagnetic seeds being starting points, is considered to be that due to magnetic attraction between paramagnetic seeds and paramagnetic colloidal particles which are magnetized by an applied magnetic field, the paramagnetic colloidal particles are trapped by the paramagnetic seeds present in their vicinity, although not limited thereto.

In visualizing the latent image, the strength of the magnetic field applied to the dispersion liquid of paramagnetic colloidal particles is not particularly limited. For example, the magnetic field strength can be 10 Oe to 500 Oe.

When the strength of the magnetic field applied to the dispersion liquid of paramagnetic colloidal particles is too large, there may be a case where paramagnetic colloidal particles adhere to a portion on the base in which paramagnetic seeds are not present, aggregation starts from this portion, and as a result, the latent image is not correctly developed. On the other hand, when the magnetic field strength is too small, there may be a case where paramagnetic colloidal particles are not trapped by the paramagnetic seeds, and the latent image is not visualized.

The suitable range of the magnetic field strength varies depending on the particle size of paramagnetic seeds, the strength of magnetization of paramagnetic seeds, the particle size of paramagnetic colloidal particles, the strength of magnetization of paramagnetic colloidal particles, the density of paramagnetic seeds present on the base, the concentration of the dispersion liquid of paramagnetic colloidal particles, etc. Consequently, the strength of the magnetic field to be applied in visualizing the latent image may be appropriately determined by performing a preliminary experiment or the like.

On the other hand, when the strength of the magnetic field to be used is predetermined, it is possible to determine the particle size of paramagnetic seeds, the strength of magnetization of paramagnetic seeds, the particle size of paramagnetic colloidal particles, the strength of magnetization of paramagnetic colloidal particles, the density of paramagnetic seeds present on the base, the concentration of the dispersion liquid of paramagnetic colloidal particles. etc., in accordance with the predetermined strength of the magnetic field.

As described above, the magnetic field strength suitable for visualizing the latent image in this embodiment tends to largely depend on the density, size, and strength of magnetization of paramagnetic seeds present in the latent image. Therefore, with respect to a latent image in which these parameters are not known, it is difficult to determine the strength of the magnetic field, and the magnetization and particle size of paramagnetic colloidal particles necessary for visualizing the image. However, it is difficult for a third party to know the density, size, and strength of magnetization of paramagnetic seeds present in the latent image. Therefore, when the method of visualizing a latent image according to this embodiment is applied to reproduction of recorded information, it is difficult for a third party to set conditions for reproducing recorded information (performing visualization), i.e., to determine the strength of the magnetic field to be applied. Thereby, high confidentiality can be achieved.

The direction of the magnetic field applied to the dispersion liquid of paramagnetic colloidal particles in visualizing the latent image is not particularly limited. For example, the magnetic field can be applied perpendicular to the base.

Furthermore, in order to apply the magnetic field, a permanent magnet may he used, or a magnetic field may be generated by applying a current to a coil.

The paramagnetic colloidal particles of the dispersion liquid of paramagnetic colloidal particles used in this embodiment are not particularly limited as long as they exhibit paramagnetism, and may be a solid or a liquid.

Specific examples of paramagnetic colloidal particles are the same as those described for the paramagnetic seeds. The concentration of paramagnetic powder in paramagnetic colloidal particles may be, for example, 1 to 10 g/cm$^3$.

The particle size of paramagnetic colloidal particles is not particularly limited as long as the paramagnetic colloidal particles can be dispersed in a dispersion medium. As the particle size of paramagnetic colloidal particles increases, visualization of the latent image can be more quickly realized. In this embodiment, the particle size of paramagnetic colloidal particles may be, for example, about 100 nm to 100 μm and furthermore about 1 to 50 μm. Here, the particle size refers to the Stokes diameter measured by laser diffraction/light scattering techniques.

The magnetization of paramagnetic colloidal particles in a magnetic field of 1,000 Oe may be about 1 to 1,000 emu/g and furthermore about 10 to 100 emu/g.

However, when the strength of magnetization of paramagnetic colloidal particles is too large, there may be a case where paramagnetic colloidal particles adhere to a portion on the base in which paramagnetic seeds are not present, aggregation starts from this portion, and as a result, the latent image is not correctly developed. On the other hand, when the strength of paramagnetic colloidal particles is too small or the particle size of paramagnetic colloidal particles is too large, there may be a case where paramagnetic colloidal particles are not trapped by the paramagnetic seeds, and the latent image is not visualized.

The suitable ranges of the strength of magnetization and particle size of paramagnetic colloidal particles vary depending on the particle size of paramagnetic seeds, the strength of magnetization of paramagnetic seeds, the density of paramagnetic seeds present on the base, the concentration of the dispersion liquid of paramagnetic colloidal particles, the strength of the magnetic field to be applied, etc. Consequently. the dispersion liquid of paramagnetic colloidal particles used when the latent image is visualized may be appropriately determined by performing a preliminary experiment or the like.

As described above, the strength of magnetization and particle size of paramagnetic colloidal particles suitable for visualizing the latent image in this embodiment tend to largely depend on the density, size, and strength of magnetization of paramagnetic seeds present in the latent image. Therefore, with respect to a latent image in which these parameters are not known, it is difficult to determine the strength of the magnetic field, and the magnetization and the particle size of paramagnetic colloidal particles necessary for visualizing the image. However, it is difficult for a third party to know the density, size, and strength of magnetization of paramagnetic seeds present in the latent image. Therefore, when the method of visualizing a latent image according to this embodiment is applied to reproduction of recorded information, it is difficult for a third party to set conditions for reproducing recorded information (performing visualization), i.e., to determine the dispersion liquid of paramagnetic colloidal particles to be used). Thereby, high confidentiality can be achieved.

When the visualized latent image (aggregation of paramagnetic colloidal particles) is optically detected, in order to increase the absorptivity or reflectivity to light used for detection, the surface of paramagnetic colloidal particles may be coated with a material having a high absorptivity or reflectivity to light of a light source for measurement. Specific examples of the coating material include Au, although not limited thereto.

As the dispersion medium of the dispersion liquid, any dispersion medium which can disperse paramagnetic colloidal particles and in which aggregation of paramagnetic colloidal particles can be observed can be used without limitations.

If dispersion of paramagnetic colloidal particles in the dispersion medium is stable, the latent image can be visualized stably. Therefore, it is possible to appropriately select the type of dispersion medium according to the paramagnetic colloidal particles to be used so that stable dispersion can be achieved. Furthermore, in order to stabilize the dispersion of paramagnetic colloidal particles in the dispersion medium, a surfactant may also be used.

In the case where the visualized latent image is optically detected, if the light transmittance of the dispersion medium to light of a light source to be used is high, detection can be performed with high sensitivity. Therefore, the type of dispersion medium may be selected appropriately according to the wavelength of the light source to be used for detection.

Specific examples of the dispersion medium include, but are not limited to, aqueous solvents, such as water and physiological saline: and organic solvents, such as ethanol. The viscosity of the dispersion medium may be appropriately adjusted, for example, by addition of a viscosity modifier.

The concentration of paramagnetic colloidal particles in the dispersion medium is not particularly limited, and for example, may be 0.1% to 10% by volume.

The amount of the dispersion liquid of paramagnetic colloidal particles used in the visualization of a latent image is not particularly limited, and is determined so that the base on which the latent image is formed can be fully immersed in the dispersion liquid of paramagnetic colloidal particles.

The time required for the visualization is not limited and for example, is about 5 to 60 seconds.

During the visualization, the dispersion liquid of paramagnetic colloidal particles may be left to stand, or ultrasound may be applied to the dispersion liquid of paramagnetic colloidal particles so as to assist the trapping of paramagnetic colloidal particles by the paramagnetic seeds present in their vicinity.

In the case where the dispersion medium of the dispersion liquid of paramagnetic colloidal particles is a polar (hydrophilic) solvent, the surfaces of the base and the paramagnetic seeds may be subjected to hydrophilization treatment. When hydrophilization treatment is performed on the base and the paramagnetic seeds, the dispersion liquid of paramagnetic colloidal particles tends to have a stronger affinity for the base and the paramagnetic seeds, and paramagnetic colloidal particles tend to be more easily trapped by the paramagnetic seeds. As the hydrophilization treatment, any known treatment may be carried out. For example, ultraviolet irradiation treatment may be carried out.

The method for detecting or reproducing a visualized latent image is not particularly limited. The visualized latent image may be detected or reproduced visually or may be optically or magnetically detected or reproduced. In the authenticity assessment method according to this embodiment, when a visualized latent image is detected, the object under test is determined to be authentic, and when an image does not appear, the object under test is determined to be counterfeit.

After the latent image is visualized, when the application of the magnetic field is stopped so that the paramagnetic colloidal particles and the paramagnetic seeds are each brought back to a non-magnetized, the paramagnetic colloidal particles aggregated on the paramagnetic seeds are dispersed, and the visualized image is brought hack to a latent image.

Next, an article having an authenticity assessment unit according to this embodiment will be described.

In the article having an authenticity assessment unit according to this embodiment, a magnetic field is applied to the authenticity assessment unit of the article, for example, by moving a permanent magnet closer to the authenticity assessment unit. By confirming that a latent image is visualized and a predetermined image is displayed, authenticity is verified.

Examples of such an article having an authenticity assessment unit include credit cards and various certificates.

FIG. 1 is a schematic diagram of an article 1 having an authenticity assessment unit according to this embodiment. An authenticity assessment unit 11 includes a closed cell 12, the interior of which is observable. The cell 12 is filled with a dispersion liquid in which paramagnetic colloidal particles 13 are dispersed. A base 15 is disposed on a bottom of the cell 12, the base 15 having a latent image portion on which a plurality of very small paramagnetic seeds 14 which are not visible are immobilized in the form of an image.

In the example shown in FIG. 1, a permanent magnet 16 is arranged below the authenticity assessment unit 11. Under the influence of a magnetic field generated from the permanent magnet 16, paramagnetic colloidal particles 13 are aggregated in the form of chains on the paramagnetic seeds 14. Thereby, the latent image formed by the paramagnetic seeds 14 appears as a visible image.

The material constituting the cell is not particularly limited as long as the interior of the cell is observable and the cell can be sealed. Examples thereof include transparent materials, such as glass and light-transmissive resins, such as acrylic resins, although not limited thereto. Furthermore, the shape of the cell is not limited.

As the base having a latent image portion on which a plurality of paramagnetic seeds are immobilized in the form of an image and the dispersion liquid of paramagnetic colloidal particles, the same materials as those described above can be used.

The particle size and strength of magnetization of paramagnetic seeds, the particle size and strength of magnetization of paramagnetic colloidal particles, the density of the paramagnetic seeds present on the base, and the concentration of the dispersion liquid of paramagnetic colloidal particles can be set at a concentration which can visualize the latent image at the strength of the magnetic field that will be used during authenticity assessment, i.e., during visualization.

EXAMPLES

The examples of this embodiment will be described below. However, it is to be understood that the embodiment is not limited to the examples.

Example 1

A silicon oxide substrate was prepared, and a surface of the substrate was modified in a grid-like pattern (with a spacing of 30 μm and an area of each grid point of about 5 μm×5 μm) with 3-(2-aminoethylamino)propyltrimethoxysilane. Next, paramagnetic (superparamagnetic) seeds [carboxyl group-modified $Fe^2O_3$ (magnetite) particles: nanomag-D PEG-COOH manufactured by Micromod (Germany); particle size: about 130 nm: magnetization in a magnetic field of 1,000 Oe: 43 emu/g], in an amount of about 20 particles for each area of about 5 μm×5 μm, were immobilized on the portion of the substrate, such potion being modified with 3-(2-aminoethylamino)propyltrimethoxysilane by means of ionic bonds between terminal amino groups of 3-(2-aminoethylamino)propyltrimethoxysilane and carboxyl groups of the paramagnetic seeds. Thereby, a grid-like latent image was formed.

Furthermore, a colloidal dispersion liquid was prepared by dispersing paramagnetic particles with an average particle size of 2.8 μm [polymer-carboxyl group-modified $Fe_2O_3$ (magnetite) particles (M-270 manufactured by Dynal)] in-purified water such that the volume ratio of paramagnetic particles to water was 1:10.

Next, the silicon oxide substrate provided with the latent image was placed in a petri dish, the dispersion liquid of paramagnetic colloidal particles was poured in the petri dish, and the petri dish was left to stand on an external magnetic field (permanent magnet).

Figure 2:
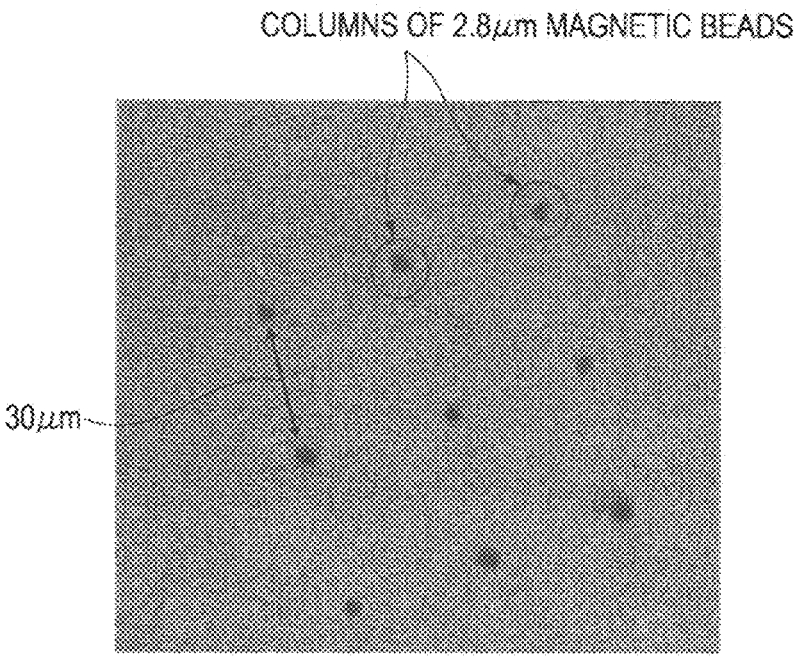
FIG. 2 is a photograph showing a latent image visualized in Example 1.

FIG. 2 is a photograph of the system taken from above. Paramagnetic colloidal particles were trapped and aggregated on each area on which paramagnetic seeds were immobilized, and the latent image was visualized. Furthermore, in this system. the aggregates were inclined by shilling the magnetic field, and as a result, it was confirmed that about eight paramagnetic colloidal particles were joined in the form of chains in each area.

Example 2

A silicon oxide substrate was prepared, and a surface of the substrate was modified in the shape of the number "4" with 3-(2-aminoethylamino)propyltrimethoxysilane. Next, the same paramagnetic (superparamagnetic) seeds as those used in Example 1, in an amount of about 32,400 particles, were substantially evenly immobilized on the modified portion by means of ionic bonds between terminal amino groups of 3-(2-aminoethylamino)propyltrimethoxysilane and carboxyl groups of the paramagnetic seeds. Thereby, a latent image in the shape Of the number "4" was formed.

Next, the silicon oxide substrate provided with the latent image was placed in a petri dish, the same dispersion liquid of paramagnetic colloidal particles as that prepared in Example 1 was poured in the petri dish, and a permanent magnet of about 100 Oe was placed on a lateral side (left side with respect to the number "4") of the petri dish.

Figure 3:
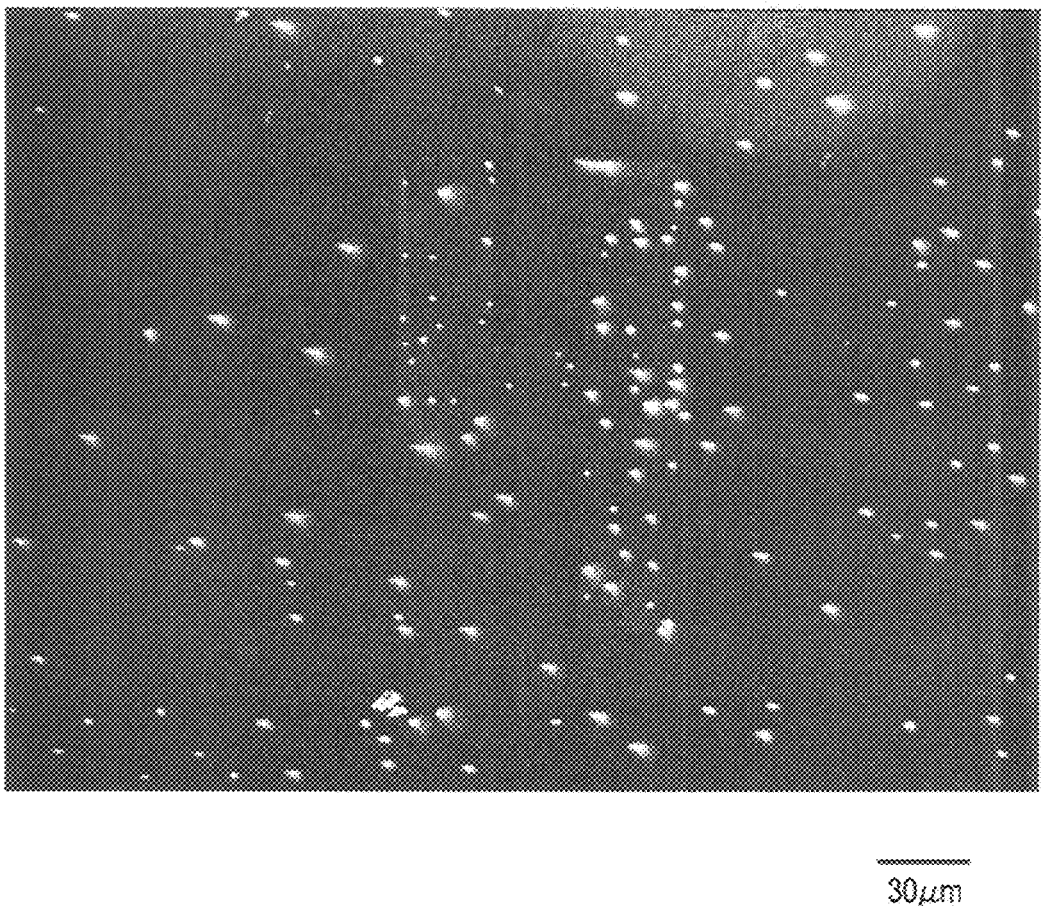
FIG. 3 is a photograph showing a latent image visualized in Example 2.

FIG. 3 is a photograph of the system taken from above. Paramagnetic colloidal particles were trapped on the latent image, and the number "4" was visualized.

The embodiment of the present invention can be applied to prevention of counterfeiting of credit cards; valuable instrument, such as gift certificates; and various certificates, such as certificates verifying the authenticity of brand-name products and equipment parts. Furthermore, the embodiment of the present invention can be used for reproducing recorded highly confidential information.

What is claimed is:

1. An article, comprising:

a substrate, wherein the substrate was subjected to a first surface treatment that resulted in chemical modifying groups on the substrate; and a plurality of paramagnetic seeds that have been subjected to a second surface treatment that resulted in chemical modifying groups on the plurality of paramagnetic seeds, wherein the plurality of paramagnetic seeds have been chemically immobilized on the substrate due to bonding of the chemical modifying groups on the substrate with the chemical modifying groups on the plurality of paramagnetic seeds, and wherein a dispersion liquid of hydrophilic paramagnetic colloidal particles has covered the plurality of paramagnetic seeds.

2. The article of claim 1, wherein the article includes a bank note, an instrument, a certificate, a credit card, or a classified document.

3. The article of claim 1, wherein in response to a magnetic field being applied to the article, at least some of the hydrophilic paramagnetic colloidal particles form an aggregate on at least one paramagnetic seed of the plurality of paramagnetic seeds.

4. The article of claim 3, wherein the magnetic field has a strength of about 10 Oe to about 500 Oe.

5. The article of claim 1, wherein the plurality of paramagnetic seeds is hydrophilic.

6. The article of claim 1, wherein the plurality of paramagnetic seeds is arranged in a shape of an image.

7. The article of claim 6, wherein the image comprises at least one of a symbol, a bar code, an authenticity mark, or text.

8. The article of claim 1, wherein the plurality of paramagnetic seeds comprises at least one paramagnetic seed that has a magnetization strength of about 40 emu/g to about 100 emu/g.

9. The article of claim 1, wherein the plurality of paramagnetic seeds comprises at least one paramagnetic seed that has a particle size of about 8 nm to about 40 nm.

10. The article of claim 1, wherein the plurality of paramagnetic seeds comprises at least one of: a paramagnetic powder, a paramagnetic powder attached to a polymer material, and a paramagnetic powder supported in a carbon nanotube.

11. The article of claim 1, wherein the dispersion liquid comprises about 0.1% to about 10% paramagnetic colloidal particles by volume of the dispersion liquid.

12. The article of claim 1, wherein the hydrophilic paramagnetic colloidal particles comprise at least one paramagnetic colloidal particle that has a magnetization strength of about 1 emu/g to about 1000 emu/g in a magnetic field of about 1000 Oe.

13. The article of claim 1, wherein the hydrophilic paramagnetic colloidal particles comprise at least one paramagnetic colloidal particle that has a size of about 100 nm to about 100 μm.

14. A method to make an article, the method comprising:

subjecting a substrate to a first surface treatment that results in chemical modifying groups on the substrate;

subjecting a plurality of paramagnetic seeds to a second surface treatment that results in chemical modifying groups on the plurality of paramagnetic seeds;

placing each of the plurality of paramagnetic seeds on the substrate;

chemically immobilizing the plurality of paramagnetic seeds on the substrate by bonding the chemical modifying groups on the substrate with the chemical modifying groups on the plurality of paramagnetic seeds; and immersing the plurality of paramagnetic seeds in a dispersion liquid of hydrophilic paramagnetic colloidal particles wherein the dispersion liquid covers the plurality of paramagnetic seeds.

15. The method of claim 14, wherein chemically immobilizing each of the plurality of the paramagnetic seeds on the substrate includes forming an image.

16. An article, comprising:

a substrate having chemical modifying groups on a surface of the substrate; and a plurality of paramagnetic seeds having chemical modifying groups, wherein the plurality of paramagnetic seeds have been chemically immobilized on the substrate due to bonding of the chemical modifying groups on the surface of the substrate with the chemical modifying groups on the plurality of paramagnetic seeds, wherein a dispersion liquid of hydrophilic paramagnetic colloidal particles has covered the plurality of paramagnetic seeds, wherein a hydrophilization treatment of the substrate and the plurality of paramagnetic seeds increases an affinity of the hydrophilic paramagnetic colloidal particles towards the substrate and the plurality of paramagnetic seeds, and wherein the hydrophilic paramagnetic colloidal particles can be trapped by the plurality of paramagnetic seeds due to the affinity of the hydrophilic paramagnetic colloidal particles towards the plurality of paramagnetic seeds being increased.

17. The article of claim 16, wherein in response to a magnetic field applied to the article, at least some of the hydrophilic paramagnetic colloidal particles form an aggregate on at least one paramagnetic seed of the plurality of paramagnetic seeds.

18. An article, comprising:

a substrate having a surface with chemical modifying groups; and a plurality of paramagnetic seeds having chemical modifying groups attached thereto, wherein the plurality of paramagnetic seeds have been chemically immobilized on the substrate due to bonding of the chemical modifying groups on the surface of the substrate with the chemical modifying groups on the plurality of paramagnetic seeds, wherein a dispersion liquid of hydrophilic paramagnetic colloidal particles has covered the plurality of paramagnetic seeds, and wherein the hydrophilic paramagnetic colloidal particles can be trapped by the plurality of paramagnetic seeds, when in response to a hydrophilization treatment of the substrate and the plurality of paramagnetic seeds.

19. The article of claim 18, wherein the plurality of paramagnetic seeds is hydrophilic.

* * * * *